United States Patent [19]

Speaker

[11] 4,258,971

[45] Mar. 31, 1981

[54] SOCKET FOR BULB WITH BENT WIRE TERMINALS

[75] Inventor: John A. Speaker, Mequon, Wis.

[73] Assignee: J. W. Speaker Corp., Milwaukee, Wis.

[21] Appl. No.: 3,044

[22] Filed: Jan. 12, 1979

[51] Int. Cl.[3] ..... H01R 4/48

[52] U.S. Cl. ..... 339/52 S; 339/56; 339/262 F

[58] Field of Search ..... 339/50 R, 50 S, 52–54, 339/57, 258 F, 259 F, 262 F, 258 S, 258 P, 56

[56] References Cited

U.S. PATENT DOCUMENTS

| | | | |
|---|---|---|---|
| 790,883 | 5/1905 | Buchanan | 339/258 F |
| 2,248,598 | 7/1941 | Yoder | 339/53 R |
| 2,454,017 | 11/1948 | Swanson | 339/56 |
| 2,483,165 | 9/1949 | Young | 339/56 |
| 2,957,157 | 10/1960 | Carter | 339/50 R |
| 3,422,302 | 1/1969 | Carpenter et al. | 313/318 |
| 3,633,149 | 1/1972 | Maltais | 339/52 R |
| 4,030,804 | 6/1977 | Enomoto | 339/258 S |
| 4,061,940 | 12/1977 | Fitzgerald et al. | 339/52 R |

FOREIGN PATENT DOCUMENTS

| | | | |
|---|---|---|---|
| 861726 | 1/1953 | Fed. Rep. of Germany | 339/56 |
| 1006075 | 4/1957 | Fed. Rep. of Germany | 339/50 R |
| 6602692 | 9/1966 | Netherlands | 339/52 R |
| 700317 | 11/1953 | United Kingdom | 339/52 S |

*Primary Examiner*—John McQuade
*Attorney, Agent, or Firm*—Quarles & Brady

[57] ABSTRACT

A socket for a tubular bulb having a bent wire terminal at each end includes a base having a pair of spaced apart terminal contacts. Each of the terminal contacts includes an electrically conductive leaf spring and a bulb retaining member positioned inboard of the leaf spring. The bulb retaining members have bent wire terminal receiving slots and the leaf springs are biased towards each other. When the bulb is properly positioned in the socket, each of the bent wire terminals extend through its own slot in a bulb retaining member into electrical contact with the flat blade surface of a leaf spring. The biased leaf springs cooperate with the slots in the bulb retaining member to retain the bulb securely in the socket and prevent it from being accidentally dislodged.

7 Claims, 8 Drawing Figures

Fig. 5
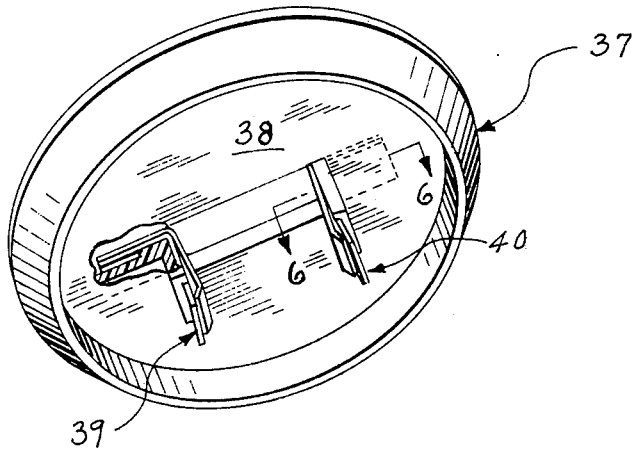
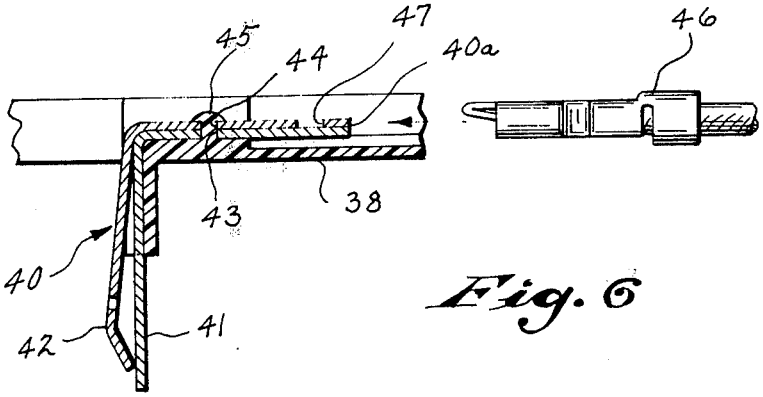
Fig. 6
Fig. 7
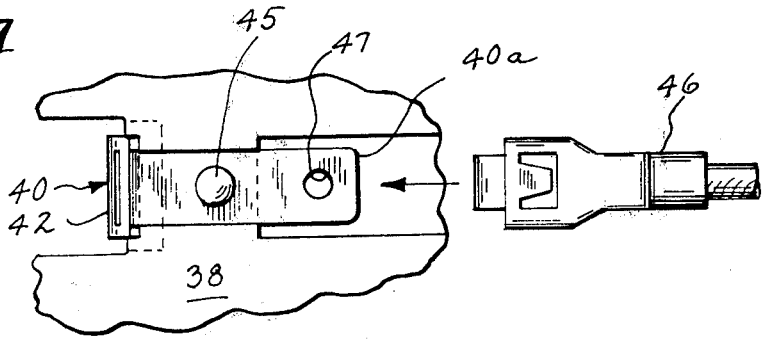
Fig. 8
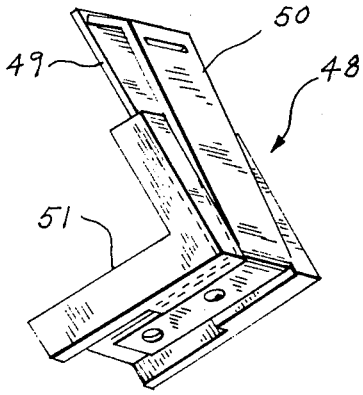

SOCKET FOR BULB WITH BENT WIRE TERMINALS

The present invention relates to sockets for light bulbs and more particularly to light bulb sockets for use with bulbs having bent wire terminals.

BACKGROUND OF THE INVENTION

In the past, various attempts have been made to develop inexpensive light bulbs which do not have the relatively expensive bases of metal or plastic with metal conducting pins or contacts which are found on conventional light bulbs.

One of the more promising light bulbs which has been developed that does not have a base is that disclosed in the Carpenter et al U.S. Pat. No. 3,422,302. The light bulb of that patent includes a filament in a tubular glass envelope and a pair of wire leads connected to the ends of the filament. Each of the wire leads passes through a glass seal at the ends of the envelope to the outside. The portion of the lead which is outside the envelope is bent at a series of angles to form an angular loop and the free end is embedded in the glass seal. Lights having such bent wire loop terminals obviously cannot be used in the conventional socket. Therefore, it has been necessary to develop sockets especially adapted for use with such light bulbs.

One of the most common sockets used for such light bulbs has a pair of shaped leaf spring contacts which are biased away from each other. The bulb is inserted into that socket by hooking the bent wire loop terminals of the bulb over the shaped leaf spring contacts and is retained in the socket by the biased contacts. Although such sockets are fairly widely used they are not without disadvantage. For example, if the outward pressure exerted by the biased lead spring contacts is too great, the embedded end of the bent wire loop can be pulled out of the glass seal damaging the bulb, and if the tension is not great enough the bulb can be dislodged from electrical contact accidentally.

SUMMARY OF THE INVENTION

The present invention relates to a socket for a tubular light bulb having a bent wire terminal at each end. The socket includes a base having a pair of spaced apart terminal contacts. Each of the contacts includes an electrically conductive leaf spring and a bulb retaining member which is positioned inboard of the leaf spring. The bulb retaining members each have a wire terminal receiving slot, and the leaf springs are biased towards each other. When the tubular bulb is properly positioned in the socket each of the bent wire terminals of the bulb extend through a slot in a bulb retaining member into electrical contact with the flat blade surface of an electrically conductive leaf spring. The biased leaf springs cooperate with the slots in the bulb retaining members to securely retain the bulb in the socket and to prevent it from being accidentally dislodged or moved to a position of less than complete electrical contact. Since no outward tension is exerted on the bent wire terminals of the bulb, there is no danger of the terminal or the bulb being damaged.

In a preferred embodiment of the invention, the lower portions of each of the electrically conductive leaf springs is received in a female terminal which is housed in an integral sleeve on the socket base. The female terminals are attached to conductors for connection to a power source.

In the preferred embodiment, the bulb retaining member and the adjacent leaf spring also are provided with interlocking means which assures the proper alignment of the bulb retaining member with the leaf spring. The innerlocking means is preferably a tubular projection on the leaf spring and a tubular projection receiving aperture in the retaining member.

The preferred embodiment of the tubular retaining member also is provided with a second aperture which receives a detent of the female terminal member so that the interlock combination of the leaf spring and bulb retaining member are securely retained in the female terminal member.

In another embodiment of the invention which is particularly adapted for use with a dual filament bulb, such as those used as tail and stop lights for automobiles, one of the contacts includes a pair of electrically conductive leaf springs separated by insulation and a pair of retaining members each having a terminal receiving slot.

From the foregoing and the description which follows, it will be apparent that it is an object of the present invention to disclose a reliable, inexpensive socket for a tubular light bulb having a bent wire terminal at each end.

It is a further object to disclose a socket which retains a tubular light bulb securely in electrical contact without putting possible destructive tension on the bent wire terminals.

It is a still further object of the invention to disclose as a second embodiment a relatively simple, inexpensive and reliable socket for use with a dual filament tubular bulb having bent wire terminals.

These and other objects and advantages of the invention will be apparent to those skilled in the art from the description and the drawings which follow.

BRIEF DESCRIPTION OF THE DRAWINGS

FIG. 5 is a perspective view, partly in section, of another embodiment of the socket of the present invention;

FIG. 6 is an enlarged sectional view taken along lines 6—6 of FIG. 5 which also shows a female connector aligned for connection to the terminal contact;

FIg. 7 is a top view of the components shown in FIG. 6; and

FIG. 8 is a perspective view of a separate terminal contact unit.

DESCRIPTION OF THE PREFERRED EMBODIMENT

Figure 1:
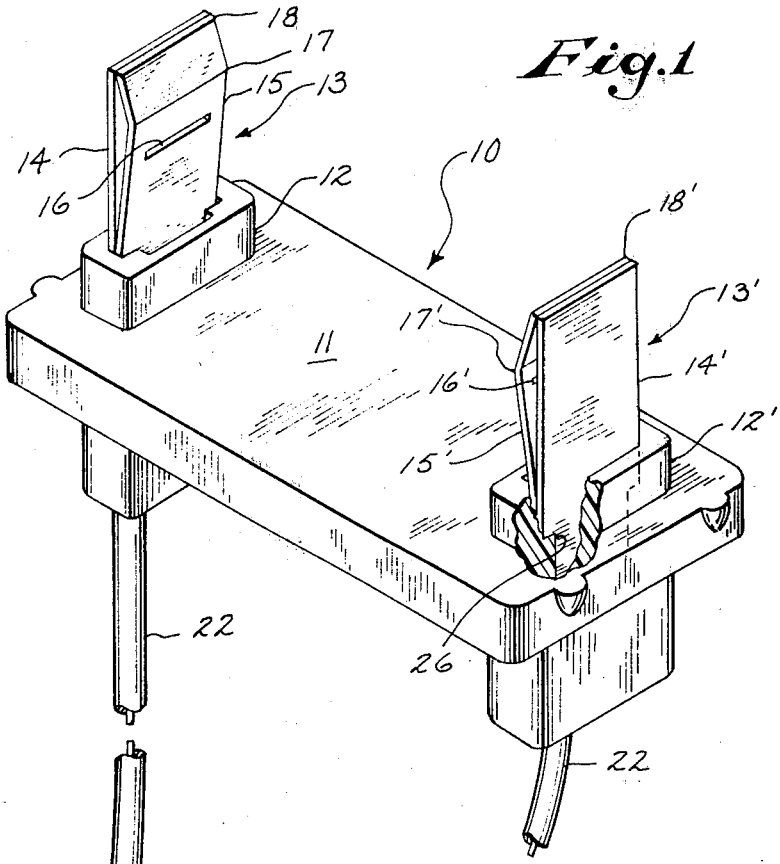
FIG. 1 is a perspective view, partly in section, of an embodiment of the socket of the present invention.

As seen in FIG. 1 of the drawings, the socket 10 of the present invention includes an elongated base 11 which is molded of an insulating materials, preferably a thermoplastic resin, such as a polyester resin. The base 11 has a pair of integral sleeves 12,12'; one of which is located adjacent each end of the base 11. Projecting from the sleeves 12,12' are terminal contacts 13,13'. The terminal contacts 13,13' include electrically conductive leaf springs 14,14' which are biased towards each other and bulb retaining members 15,15' which have bent wire terminal receiving slots 16,16'. Each of the retaining members 15,15' is positioned inboard of the adjacent leaf spring 14,14'.

Figure 3:
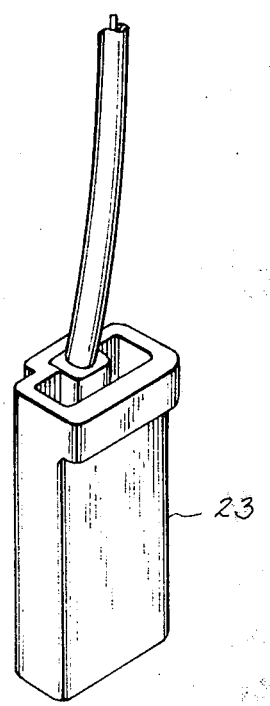
FIG. 3 is a cross sectional view of an assembled terminal contact of the socket of FIG. 1 with the bent wire terminal of a tubular bulb in position.
Figure 3:
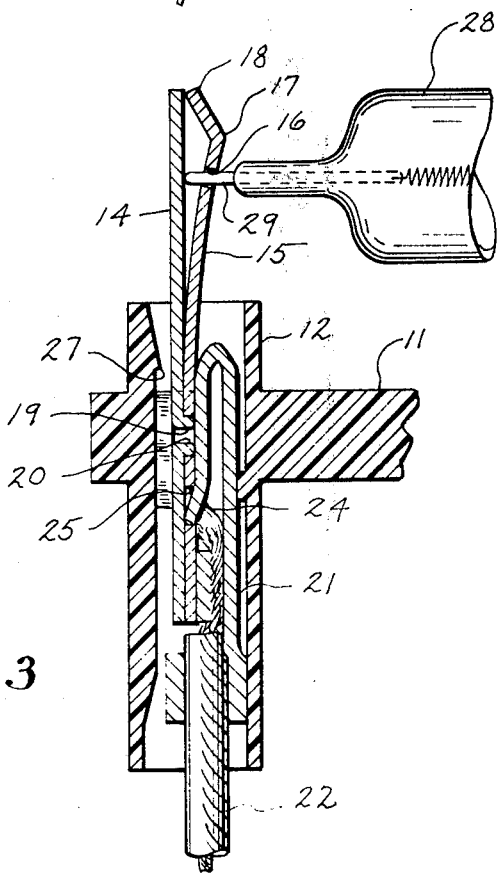
Figures 2, 4:
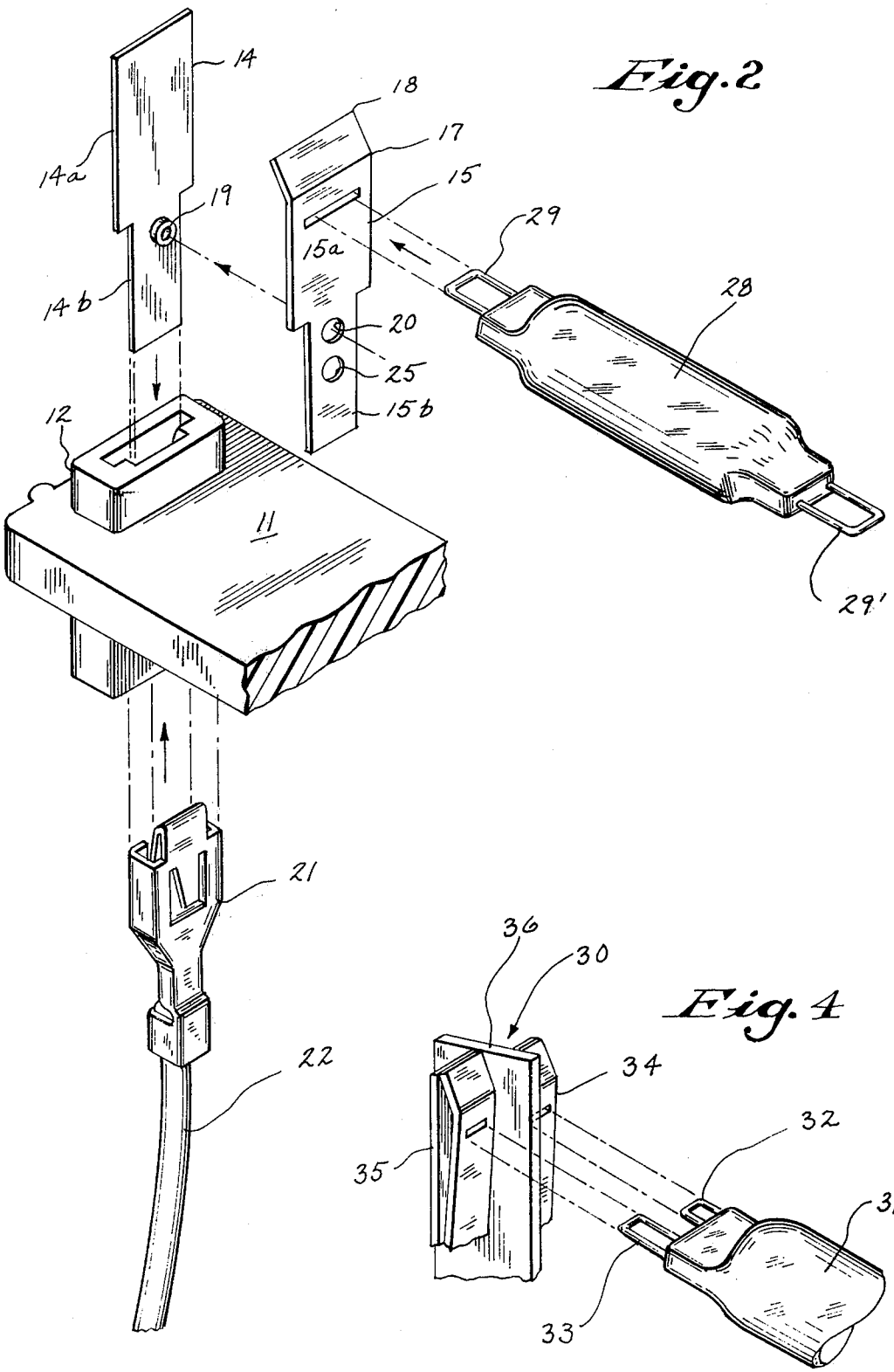
FIG. 2 is an exploded, perspective view showing the components of one of the terminal contacts of the socket of FIG. 1.
FIG. 4 is a partial view of an embodiment of a socket designed for use with a tubular bulb having a double filament and two bent wire terminals at one end.

Referring now to FIGS. 2 and 3 of the drawings, the terminal contact 13, which is identical to the contact 13', will be described. As seen therein, the electrically conductive leaf spring 14 has a broad blade-like upper portion 14*a* and a tang 14*b*. The bulb retaining member 15 also has an upper blade portion 15*a* and a tang 15*b*. The blade portion 15*a* of the retaining member 15 includes the slot 16 and it is bent at 17 so the tip 18 is non-planar with the remainder of the blade 15*a*. When the leaf spring 14 and the retaining member 15 are properly oriented, as seen in FIGS. 1 and 3, the tip 17 keeps the slot 16 spaced from the blade 14a of the leaf spring 14.

Returning to FIGS. 2 and 3, it can be seen that the leaf spring 14 and the retaining member 15 are provided with interlocking means which consist of a tubular projection 19 on the leaf spring 14 and a projection receiving aperture 20 in the tang 15b of the retaining member 15. In the assembly of the terminal contact 13, the projection 19 and the aperture 20 cooperate to keep the leaf spring 14 and the retaining member 15 properly aligned.

Still referring to FIGS. 2 and 3, it can be seen that the terminal contact 13 also includes a female terminal 21 which as seen in FIG. 3 is positioned in the lower portion of the sleeve 11. The female terminal 21 is a conventional NEMA "quick to connect" terminal of the slip-on type which is connected to a flexible conductor 22 which leads to an adaptor 23 (seen only in FIG. 1) for connection to a power source. As seen only in FIG. 3, the female terminal 21 has a detent 24 which cooperates with a detent receiving aperture 25 in the tang 15b of the retaining member 15 to secure the innerlocked leaf spring 14 and retaining member 15 in the female terminal 21.

The preferred method of assembling the socket 10 will now be described in connection with FIGS. 2 and 3 of the drawings. First, the female terminal 21 is inserted into the bore of a sleeve 12 from below. Then a leaf spring 14 is aligned with a retaining member 15 so that the tip 18 of the retaining member 15 is in contact with the blade 14*a* of the leaf spring 14 and the projection 19 on the leaf spring 14 is in the aperture 20 of the retaining member 15. The leaf spring-retaining member combination with the retaining member 15 inboard of the leaf spring 14 is then inserted from above into the bore of the sleeve 12 which contains the female conductor 21. The tangs 14*b* and 15*b* of the leaf spring 14 and retaining member 15, respectively, are forcibly inserted as a unit into the seat of the female terminal 21. When thus inserted, they are retained therein by the cooperation of the detent 24 and the detent receiving aperture 25. The internal side walls of the bores of the sleeves 12 and 12' have an internal ledge 26 partially seen in FIG. 1 which prevents the leaf spring from being inserted too far and the back wall has an internal stop 27, seen in FIG. 3 which limits the upward movement of the female terminal. As a result, once the innerlocked leaf spring 14 and retaining member 15 are snap fit into the seat of a female terminal 21 in the sleeve the components of the terminal contact are locked into place and cannot be moved or disassembled until the retaining force of the detent 24 is overcome. The described process is repeated to assemble the other terminal contact 12'. The entire socket can be thus assembled as seen in FIG. 1 without the need for soldering, external fasteners or the like.

The embodiment of the socket 10 seen in FIGS. 1, 2 and 3 is intended for use with the bulb 28 which has a single bent wire terminal 29,29' on each end. The bulb 28 has an overall length including the bent wire terminals which is slightly greater than the distance between the terminal contacts 13,13' so that the terminal contacts 13, 13' must be slightly spread apart to permit the wire terminals 29,29' of the bulb to enter into and extend through the slots 16,16' and into electrical contact with the blade portions 14a,14*a*' of the leaf springs 14,14'. When the bulb is thus positioned it is prevented from being accidentally dislodged from full electrical contact or removed from the socket by the cooperation of the inwardly biased leaf springs 14,14' and the slots 16,16' in the retaining members 15,15'. In contrast to the prior art sockets, the bulb 28 is retained within the socket 10 without placing any outward tension on the bent wire terminals 29,29' which could be potentially destructive to the bulb.

In FIG. 4 is shown a dual terminal contact unit 30 of a socket for a double filament bulb 31 of the type which may be used as a combined stop and turn signal for an automobile. The end of the bulb 31 which is shown has a pair of bent wire terminals 32 and 33. Each of the terminals 32 and 33 is connected to a different filament of the bulb and is of a different length. To accommodate the terminals 32 and 33 of the bulb 31, the dual terminal contact unit 30 has a front terminal contact 34 and a back terminal contact 35 separated by insulation 36. Each of the terminal contacts 34 and 35 can only make proper electrical contact with a respective one of the two terminals 32 and 33. The shorter terminal 32 will not reach and cannot be received or retained in the rear terminal contact 35, and the terminal 33 is too long to be improperly inserted into a contact 34. Thus, the bulb 31 cannot be improperly inserted into a socket equipped with the dual terminal contact unit 30.

Each of the terminal contacts 34 and 35 of the dual terminal contact unit 30 includes the previously described leaf spring contact and retaining member combination which functions in the same manner as in the embodiment of FIGS. 1 to 3. The leaf spring contacts of terminal contacts 34 and 35 may be connected to their respective electrical circuits by use of separate female terminals of the type previously described or in any other appropriate manner.

Those skilled in the art will appreciate that the terminal contacts of the present invention may be otherwise modified to receive bulbs with uniquely shaped terminals or with more than one bent wire terminal at one or both ends and that the structure shown in FIG. 4 represents only one such modification.

In FIGS. 5 through 7, a "low profile" socket 37 is shown which is particularly useful in automobile dome lights or the like where it is desired to mount the socket as nearly flush with the supporting surface as possible. The "low profile" socket 37 differs primarily from the socket of FIGS. 1 to 3 in that the round back plate 38 of the fixture serves as the base and that the tang portions of the terminal contacts 39 and 40 have been bent at right angles to the blade portions.

In FIGS. 6 and 7, the terminal contact 40, which is representative, is seen to include a conductive leaf spring 41 and a retaining member 42. The leaf spring 41 and retaining member 42 are each provided with an opening 43,44, respectively. When the leaf spring 41 and the retaining member 42 are properly aligned the combination can be staked as at 45 to the back plate 38 as seen in FIG. 6. Still referring to FIG. 6, it can be seen that the free end portion 40*a* of the combined leaf spring 41 and retaining member 42 combination is spaced from the base plate 38 to permit a female connector 46 of the type previously described to be used to make electrical contact. A detent opening 47 in the retaining member 42 cooperates with a detent (not shown) on the female connector 46 to retain the connector in place.

In FIG. 8 is shown a completely assembled terminal contact unit 48 which may be staked or otherwise attached to a supporting surface to form a "low profile" socket. The unit 48 includes a leaf spring contact 49 and a retaining member 50 secured in a plastic holder 51. The unit 48 once properly aligned can be staked or otherwise attached to a base to form a socket similar to that shown and described in connection with FIGS. 5 and 7.

Those skilled in the art will understand that in addition to the changes which have been discussed, other modifications and changes can be made without departing from the spirit and scope of the invention. For example, although in the embodiment shown in the drawings, the retaining member is a bent leaf spring of electrically conductive material, the retaining member can be made of plastic or other suitable material, if desired. Furthermore, the retaining member could, if desired, be molded as an integral extension of the sleeve, the base or holder.

It also will be apparent to those skilled in the art that the novel, inexpensive sockets which have been disclosed provide significant advantages over prior art sockets designed for use with tubular bulbs having wire terminals.

I claim:

1. A socket for a light bulb having a bent wire terminal at each end includes:

(a) a base having a pair of integral sleeves that are spaced apart along an axis of the base;

(b) a female terminal in each of the sleeves, each female terminal being adapted for connection to a power source;

(c) a pair of opposed, electrically conductive leaf springs, each of the leaf springs having an end portion positioned within its own sleeve and secured in the female terminal in the sleeve, the leaf springs being yieldable in opposite directions along the base axis; and (d) a pair of opposed bulb retaining members, each of the bulb retaining members being positioned inboard of a respective leaf spring and having an end portion secured within the same sleeve as its adjacent leaf spring, the bulb retaining members each having a bent wire terminal receiving slot so that when a bulb is properly positioned between the bulb retaining members the bent wire terminals of the bulb extend in opposite axial directions through slots in respective bulb retaining members and into electrical contact with respective yieldable leaf springs, which grip the bulb therebetween.

2. A socket for a light bulb with bent wire terminals extending from opposite ends of the bulb and along a bulb axis, the socket including a base and a pair of spaced apart contacts supported by the base, each contact having an electrically conductive flat spring mounted for yielding movement axially outward from a respective end of the bulb and having a bulb retaining member positioned inboard of the electrically conductive flat spring, the bulb retaining member of each contact being a conductive leaf spring which has been bent to project inwardly from the flat spring and having a wire terminal receiving slot positioned so that when the bulb is properly positioned in the socket each of the bent wire terminals extends through a slot in a bulb retaining member and is axially urged against the adjacent electrically conductive flat spring to make electrical contact therewith.

3. A socket for a light bulb with bent wire terminals extending from opposite ends of the bulb and along a bulb axis, the socket including a base and a pair of spaced apart sleeves, each containing an electrical contact, each contact including an electrically conductive member mounted for yielding movement axially outward from a respective end of the bulb, a bulb retaining member positioned inboard of the electrically conductive member and a female terminal, the electrically conductive member and the bulb retaining member of each contact having respective end portions received in a female terminal, and said bulb retaining member of each contact having a wire terminal receiving slot positioned so that when the bulb is properly positioned in the socket each of the bent wire terminals extends through a slot in a bulb retaining member and is axially urged against the adjacent electrically conductive member to make electrical contact therewith.

4. The socket of claim 3, wherein each sleeve forms means cooperating with the members received therein and the female terminal connected to the members to anchor these members and female terminal in position within the sleeve against removal in either of two opposite directions.

5. The socket of claim 3 in which the respective end portion of the bulb retaining member of each contact is provided with a first aperture and in which each female terminal has a detent that is received in the first aperture of the bulb retaining member to which it is connected.

6. The socket of claim 5 in which the respective ends of each electrically conductive member includes a tubular projection and that of each bulb retaining member includes a second aperture for receiving the tubular projection of its adjacent conductive member to properly align the conductive member and the bulb retaining member of each contact for connection to a respective one of the female terminals.

7. An electrical contact unit for use with a socket for a light bulb having a bent wire terminal includes:

(a) a female terminal adapted for connection to a power source;

(b) a yieldable electrically conductive first leaf spring having an end portion secured in the female terminal; and (c) a bulb retaining second leaf spring having an end portion secured within the same female terminal as the first leaf spring, the bulb retaining leaf spring having an intermediate portion which is spaced from the first leaf spring and which has a bent wire terminal receiving slot so that the bent wire terminal of a bulb can extend through the slot and into electrical contact with the adjacent yieldable leaf spring.

* * * * *